US009881631B2

(12) United States Patent
Erdogan et al.

(10) Patent No.: US 9,881,631 B2
(45) Date of Patent: Jan. 30, 2018

(54) METHOD FOR ENHANCING AUDIO SIGNAL USING PHASE INFORMATION

(71) Applicant: Mitsubishi Electric Research Laboratories, Inc., Cambridge, MA (US)

(72) Inventors: Hakan Erdogan, Istanbul (TR); John Hershey, Winchester, MA (US); Shinji Watanabe, Arlington, MA (US); Jonathan Le Roux, Arlington, MA (US)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 0 days.

(21) Appl. No.: 14/620,526

(22) Filed: Feb. 12, 2015

(65) Prior Publication Data

US 2016/0111108 A1 Apr. 21, 2016

Related U.S. Application Data

(60) Provisional application No. 62/066,451, filed on Oct. 21, 2014.

(51) Int. Cl.

| | |
|---|---|
| ***G10L 21/00*** | (2013.01) |
| ***G10L 21/0208*** | (2013.01) |
| ***G10L 21/0216*** | (2013.01) |
| ***G10L 25/30*** | (2013.01) |
| ***G10L 25/03*** | (2013.01) |
| ***G10L 21/0324*** | (2013.01) |

(52) U.S. Cl.
CPC ..... *G10L 21/0208* (2013.01); *G10L 21/0216* (2013.01); *G10L 21/0324* (2013.01); *G10L 25/03* (2013.01); *G10L 25/30* (2013.01)

(58) Field of Classification Search
None
See application file for complete search history.

(56) References Cited

U.S. PATENT DOCUMENTS

| | | | | |
|---|---|---|---|---|
| 5,878,389 | A | 3/1999 | Avendano et al. | |
| 6,526,385 | B1 * | 2/2003 | Kobayashi | G10L 19/018 348/423.1 |
| 6,732,073 | B1 | 5/2004 | Kluender et al. | |
| 6,820,053 | B1 | 11/2004 | Ruwisch et al. | |
| 7,243,060 | B2 * | 7/2007 | Atlas | G10L 21/028 704/200 |
| 7,636,661 | B2 | 12/2009 | Leeuv et al. | |
| 7,895,038 | B2 | 2/2011 | Nishimura et al. | |

(Continued)

FOREIGN PATENT DOCUMENTS

| | | | |
|---|---|---|---|
| EP | 2151822 | A1 | 2/2010 |
| JP | 09-160590 | A | 6/1997 |

(Continued)

*Primary Examiner* — Marcus T Riley
(74) *Attorney, Agent, or Firm* — Gene Vinokur; James McAleenan; Hironori Tsukamoto

(57) ABSTRACT

A method transforms a noisy audio signal to an enhanced audio signal, by first acquiring the noisy audio signal from an environment. The noisy audio signal is processed by an enhancement network having network parameters to jointly produce a magnitude mask and a phase estimate. Then, the magnitude mask and the phase estimate are used to obtain the enhanced audio signal.

12 Claims, 5 Drawing Sheets

(56) References Cited

U.S. PATENT DOCUMENTS

| | | | | |
|---|---|---|---|---|
| 8,117,032 | B2 | 2/2012 | Charoenruengkit et al. | |
| 8,392,185 | B2 * | 3/2013 | Nakadai | G10L 15/20 704/231 |
| 8,615,393 | B2 | 12/2013 | Tashev et al. | |
| 8,645,132 | B2 | 2/2014 | Mozer et al. | |
| 8,712,770 | B2 | 4/2014 | Fukuda et al. | |
| 8,873,813 | B2 * | 10/2014 | Tadayon | G06K 9/00 382/118 |
| 2002/0116196 | A1 * | 8/2002 | Tran | G06F 1/3203 704/270 |
| 2003/0185411 | A1 * | 10/2003 | Atlas | G10L 21/0208 381/98 |
| 2004/0199384 | A1 * | 10/2004 | Hong | G10L 15/063 704/233 |
| 2014/0079297 | A1 * | 3/2014 | Tadayon | G06K 9/00 382/118 |
| 2014/0372112 | A1 * | 12/2014 | Xue | G10L 15/16 704/232 |

FOREIGN PATENT DOCUMENTS

| | | | |
|---|---|---|---|
| JP | 2010-521012 | A | 6/2010 |
| WO | 2008110870 | A2 | 9/2008 |

* cited by examiner

METHOD FOR ENHANCING AUDIO SIGNAL USING PHASE INFORMATION

RELATED APPLICATION

This U.S. Patent Application claims priority to U.S. Provisional Application Ser. No. 62/066,451, "Phase-Sensitive and Recognition-Boosted Speech Separation using Deep Recurrent Neural Networks," filed by Erdogan et al., Oct. 21, 2014, and incorporated herein by reference.

FIELD OF THE INVENTION

The invention is related to processing audio signals, and more particularly to enhancing noisy audio speech signals using phases of the signals.

BACKGROUND OF THE INVENTION

In speech enhancement, the goal is to obtain "enhanced speech" which is a processed version of the noisy speech that is closer in a certain sense to the underlying true "clean speech" or "target speech".

Note that clean speech is assumed to be only available during training and not available during the real-world use of the system. For training, clean speech can be obtained with a close talking microphone, whereas the noisy speech can be obtained with a far-field microphone recorded at the same time. Or, given separate clean speech signals and noise signals, one can add the signals together to obtain noisy speech signals, where the clean and noisy pairs can be used together for training.

Speech enhancement and speech recognition can be considered as different but related problems. A good speech enhancement system can certainly be used as an input module to a speech recognition system. Conversely, speech recognition might be used to improve speech enhancement because the recognition incorporates additional information. However, it is not clear how to jointly construct a multi-task recurrent neural network system for both the enhancement and recognition tasks.

In this document, we refer to speech enhancement as the problem of obtaining "enhanced speech" from "noisy speech." On the other hand, the term speech separation refers to separating "target speech" from background signals where the background signal can be any other non-speech audio signal or even other non-target speech signals which are not of interest. Our use of the term speech enhancement also encompasses speech separation since we consider the combination of all background signals as noise.

In speech separation and speech enhancement applications, processing is usually done in a short-time Fourier transform (STFT) domain. The STFT obtains a complex domain spectro-temporal (or time-frequency) representation of the signal. The STFT of the observed noisy signal can be written as the sum of the STFT of the target speech signal and the STFT of the noise signal. The STFT of signals are complex and the summation is in the complex domain. However, in conventional methods, the phase is ignored and it is assumed that the magnitude of the STFT of the observed signal equals to the sum of the magnitudes of the STFTs of the target audio and the noise signals, which is a crude assumption. Hence, the focus in the prior art has been on magnitude prediction of the "target speech" given a noisy speech signal as input. During reconstruction of the time-domain enhanced signal from its STFT, the phase of the noisy signal is used as the estimated phase of the enhanced speech's STFT. This is usually justified by stating that the minimum mean square error (MMSE) estimate of the enhanced speech's phase is the noisy signal's phase.

SUMMARY OF THE INVENTION

The embodiments of the invention provide a method to transform noisy speech signal to enhanced speech signals.

The noisy speech is processed by an automatic speech recognition (ASR) system to produce ASR features. The ASR features are combined with noisy speech spectral features and passed to a Deep Recurrent Neural Network (DRNN) using network parameters learned during a training process to produce a mask that is applied to the noisy speech to produce the enhanced speech.

The speech is processed in a short-time Fourier transform (STFT) domain. Although there are various methods for calculation of the magnitude of the STFT of the enhanced speech from the noisy speech, we focus on deep recurrent neural network (DRNN) based approaches. These approaches use features obtained from noisy speech signal's STFT as an input to obtain the magnitude of the enhanced speech signal's STFT at the output. These noisy speech signal features can be spectral magnitude, spectral power or their logarithms, log-mel-filterbank features obtained from the noisy signal's STFT, or other similar spectro-temporal features can be used.

In our recurrent neural network based system, the recurrent neural network predicts a "mask" or a "filter," which directly multiplies the STFT of the noisy speech signal to obtain the enhanced signal's STFT. The "mask" has values between zero and one for each time-frequency bin and ideally is the ratio of speech magnitude divided by the sum of the magnitudes of speech and noise components. This "ideal mask" is termed as the ideal ratio mask which is unknown during real use of the system, but available during training. Since the real-valued mask multiplies the noisy signal's STFT, the enhanced speech ends up using the phase of the noisy signal's STFT by default. When we apply the mask to the magnitude part of the noisy signal's STFT, we call the mask "magnitude mask" to indicate that it is only applied to the magnitude part of the noisy input.

The neural network training is performed by minimizing an objective function that quantifies the difference between the clean speech target and the enhanced speech obtained by the network using "network parameters." The training procedure aims to determine the network parameters that make the output of the neural network closest to the clean speech targets. The network training is typically done using the backpropagation through time (BPTT) algorithm which requires calculation of the gradient of the objective function with respect to the parameters of the network at each iteration.

We use the deep recurrent neural network (DRNN) to perform speech enhancement. The DRNN can be a long short-term memory (LSTM) network for low latency (online) applications or a bidirectional long short-term memory network (BLSTM) DRNN if latency is not an issue. The deep recurrent neural network can also be of other modern RNN types such as gated RNN, or clockwork RNN.

In another embodiment, the magnitude and phase of the audio signal are considered during the estimation process. Phase-aware processing involves a few different aspects:

using phase information in an objective function while predicting only the target magnitude, in a so-called phase-sensitive signal approximation (PSA) technique;

predicting both the magnitude and the phase of the enhanced signal using deep recurrent neural networks, employing appropriate objective functions that enable better prediction of both the magnitude and the phase;

using phase of the inputs as additional input to the system that predicts the magnitude and the phase; and using all magnitudes and phases of multi-channel audio signals, such as microphone arrays, in a deep recurrent neural network.

It is noted that the idea applies to enhancement of other types of audio signals. For example, the audio signals can include music signals where the task of recognition is music transcription, or animal sounds where the task of recognition could be to classify animal sounds into various categories, and environmental sounds where the task of recognition could be to detect and distinguish certain sound making events and/or objects.

DETAILED DESCRIPTION OF THE PREFERRED EMBODIMENTS

Figure 1:
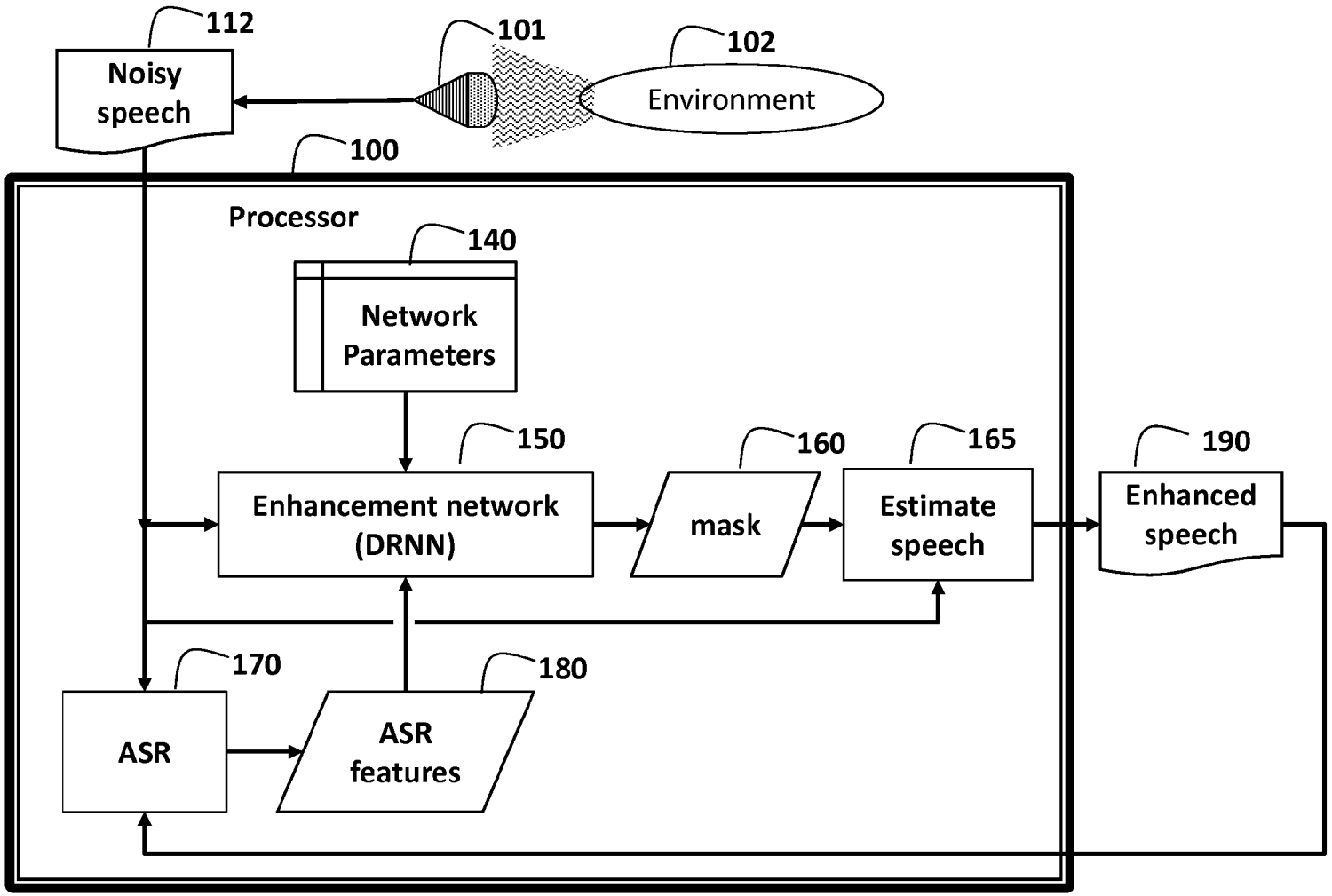
FIG. 1 is a flow diagram of a method for transforming noisy speech signals to enhanced speech signals using ASR features.

FIG. 1 shows a method for transforming a noisy speech signal 112 to an enhanced speech signal 190. That is the transformation enhances the noisy speech. All speech and audio signals described herein can be single or multi-channels acquired by a single or multiple microphones 101 from an environment 102, e.g., the environment can have audio inputs from sources such as one or more persons, animals, musical instruments, and the like. For our problem, one of the sources is our "target audio" (mostly "target speech"), the other sources of audio are considered as background.

In the case the audio signal is speech, the noisy speech is processed by an automatic speech recognition (ASR) system 170 to produce ASR features 180, e.g., in a form of an "alignment information vector." The ASR can be conventional. The ASR features combined with noisy speech's STFT features are processed by a Deep Recurrent Neural Network (DRNN) 150 using network parameters 140. The parameters can be learned using a training process described below.

The DRNN produces a mask 160. Then, during the speech estimation 165, the mask is applied to the noisy speech to produce the enhanced speech 190. As described below, it is possible to iterate the enhancement and recognition steps. That is, after the enhanced speech is obtained, the enhanced speech can be used to obtain a better ASR result, which can in turn be used as a new input during a following iteration. The iteration can continue until a termination condition is reached, e.g., a predetermined number of iteration, or until a difference between the current enhance speech and the enhanced speech from the previous iteration is less than a predermined threshold.

The method can be performed in a processor 100 connected to memory and input/output interfaces by buses as known in the art.

Figure 2:
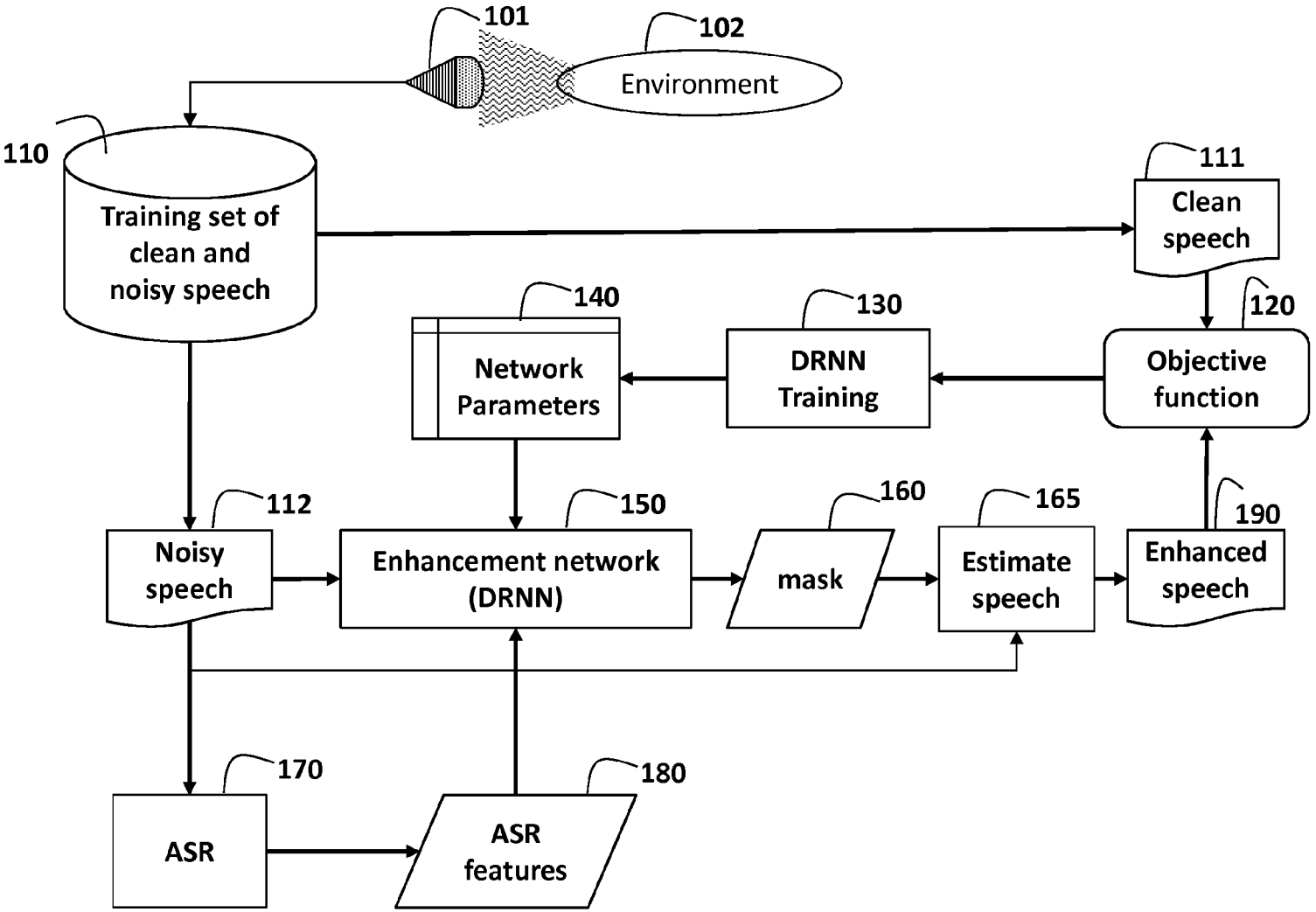
FIG. 2 is a flow diagram of a training process of the method of FIG. 1.

FIG. 2 shows the elements of the training process. Here, the noisy speech and the corresponding clean speech 111 are stored in a data base 110. An objective function (sometimes referred to as "cost function" or "error function") is determined 120. The objective function quantifies the difference between the enhanced speech and the clean speech. By minimizing the objective function during training, the network learns to produce enhanced signals that are similar to clean signals. The objective function is used to perform DRNN training 130 to determine the network parameters 140.

Figure 3:
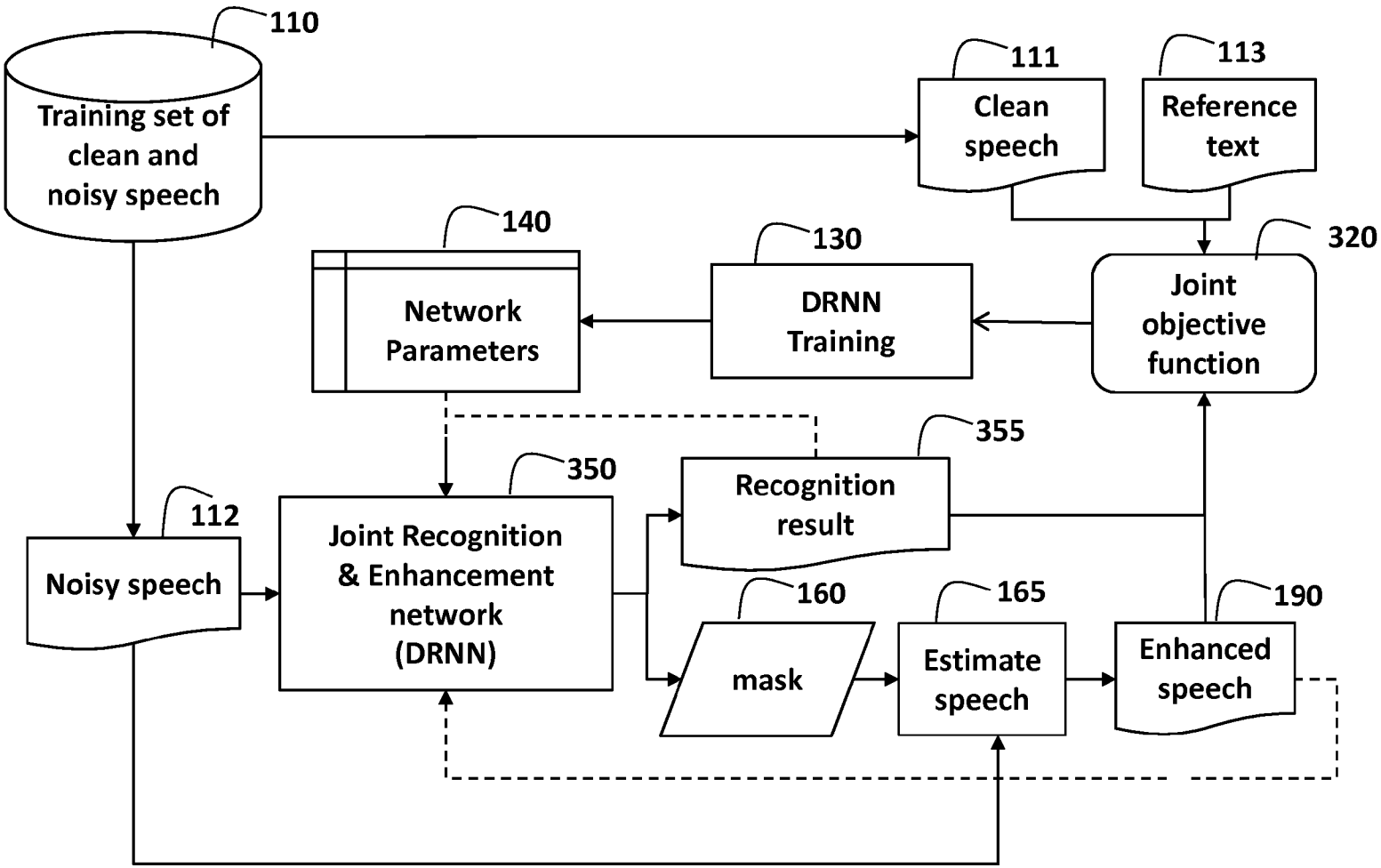
FIG. 3 is a flow diagram of a joint speech recognition and enhancement method.

FIG. 3 shows the elements of a method that performs joint recognition and enhancement. Here, the joint objective function 320 measures the difference between the clean speech signals 111 and enhanced speech signals 190 and reference text 113, i.e., recognized speech, and the produced recognition result 355. In this case, the joint recognition and enhancement network 350 also produces a recognition result 355, which is also used while determining 320 the joint objective function. The recognition result can be in the form of ASR state, phoneme or word sequences, and the like.

The joint objective function is a weighted sum of enhancement and recognition task objective functions. For the enhancement task, the objective function can be mask approximation (MA), magnitude spectrum approximation (MSA) or phase-sensitive spectrum approximation (PSA). For the recognition task, the objective function can simply be a cross-entropy cost function using states or phones as the target classes or possibly a sequence discriminative objective function such as minimum phone error (MPE), boosted maximum mutual information (BMMI) that are calculated using a hypothesis lattice.

Alternatively, the recognition result 355 and the enhanced speech 190 can be fed back as additional inputs to the joint recognition and enhancement module 350 as shown by dashed lines.

Figure 4:
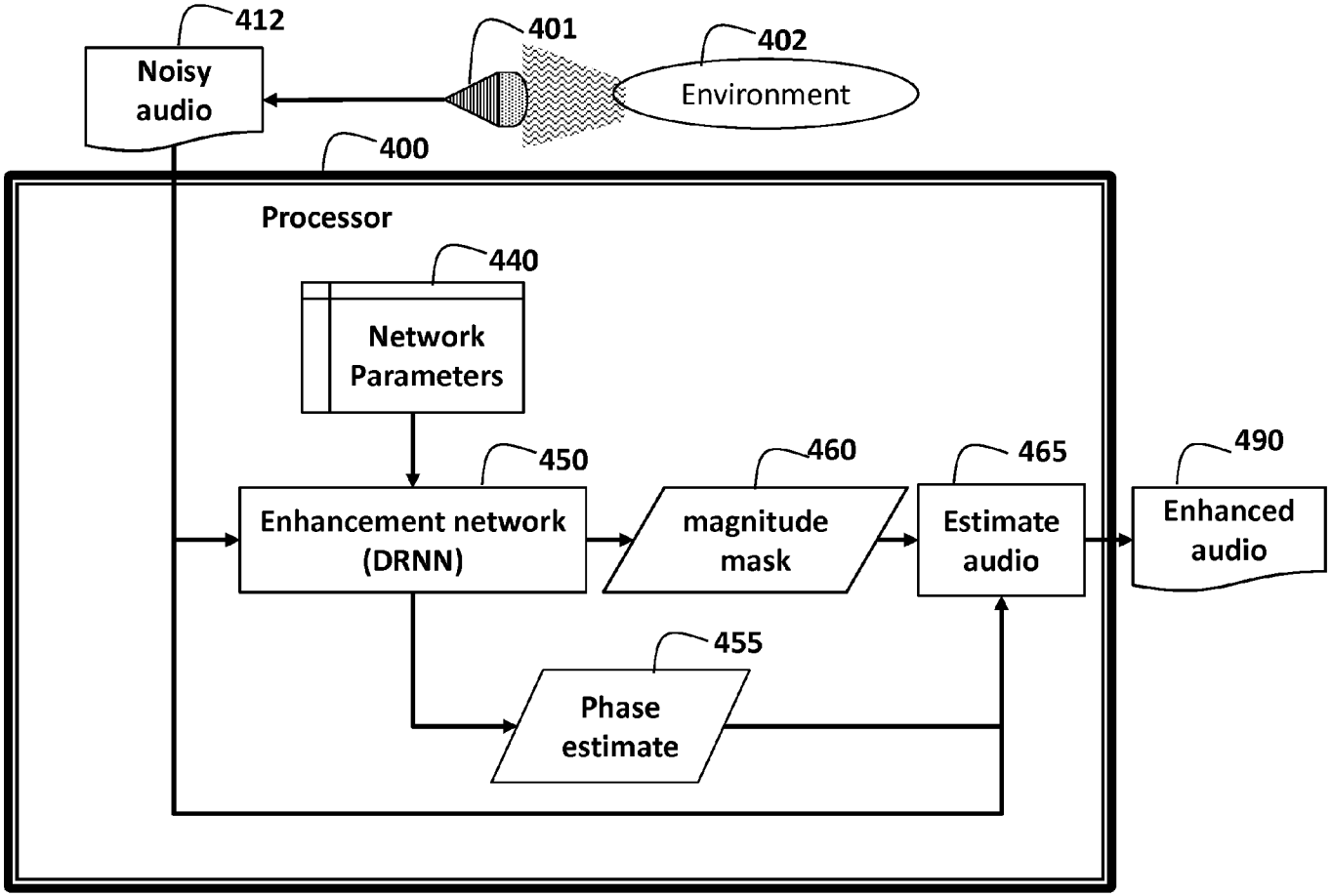
FIG. 4 is a flow diagram of a method for transforming noisy audio signals to enhanced audio signals by predicting phase information and using a magnitude mask.

FIG. 4 shows a method that uses an enhancement network (DRNN) 450 which outputs the estimated phase 455 of the enhanced audio signal and a magnitude mask 460, taking noisy audio signal features that are derived from both its magnitude and phase 412 as input and uses the predicted phase 455 and the magnitude mask 460 to obtain 465 the enhanced audio signal 490. The noisy audio signal is acquired by one or more microphones 401 from an environment 402. The enhanced audio signal 490 is then obtained 465 from the phase and the magnitude mask.

Figure 5:
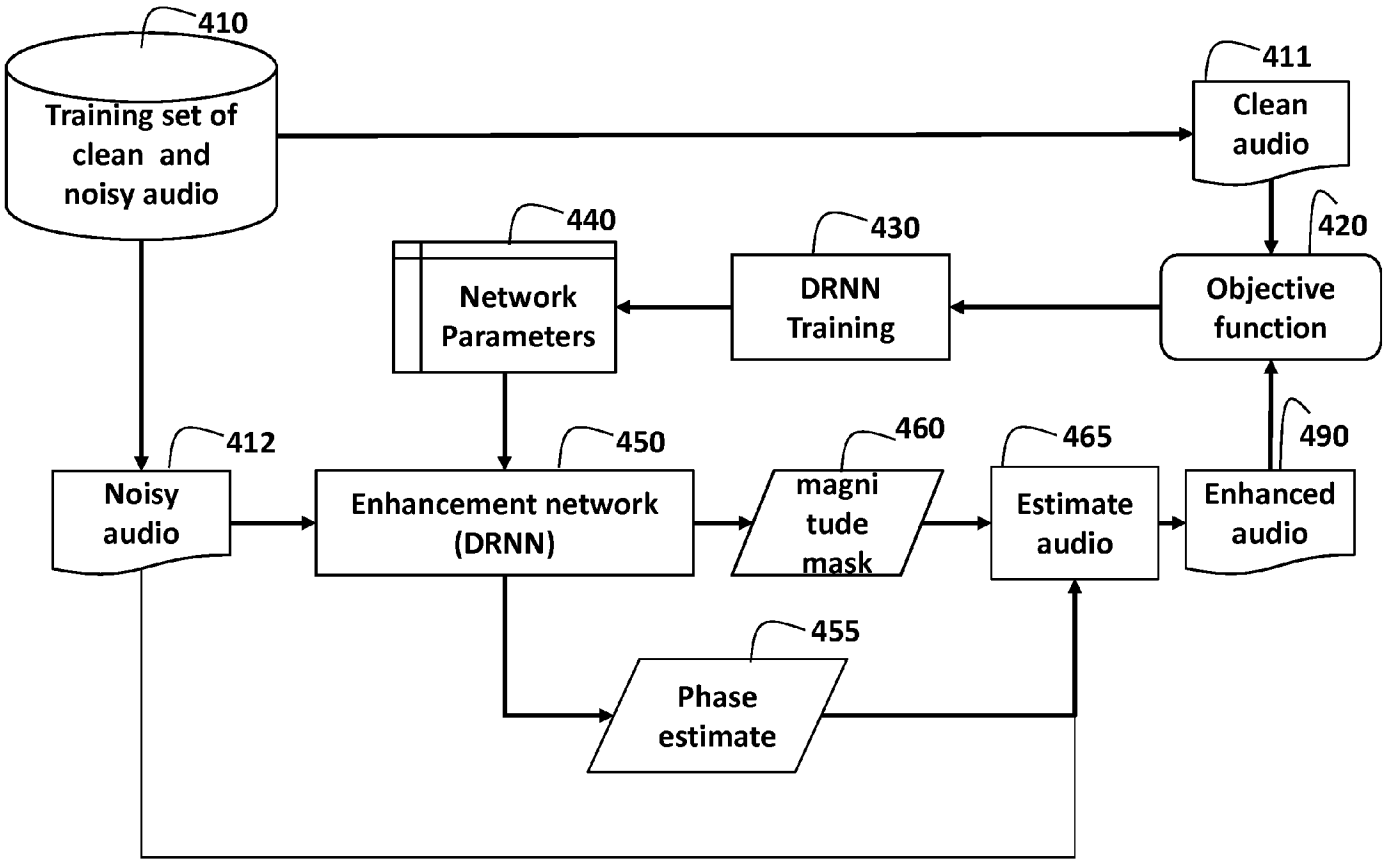
FIG. 5 is a flow diagram of a training process of the method of FIG. 4.

FIG. 5 shows the comparable training process. In this case the enhancement network 450 uses a phase sensitive objective function. All audio signals are processed using the magnitude and phase of the signals, and the objective function 420 is also phase sensitive, i.e., the objective function uses complex domain differences. The phase prediction and phase-sensitive objective function improves the signal-to-noise ratio (SNR) in the enhanced audio signal 490.

Details

Language models have been integrated into model-based speech separation systems. Feed-forward neural networks, in contrast to probabilistic models, support information flow only in one direction, from input to output.

The invention is based in part on a recognition that a speech enhancement network can benefit from recognized state sequences, and the recognition system can benefit from the output of the speech enhancement system. In the absence of a fully integrated system, one might envision a system that alternates between enhancement and recognition in order to obtain benefits in both tasks.

Therefore, we use a noise-robust recognizer trained on noisy speech during a first pass. The recognized state sequences are combined with noisy speech features and used as input to the recurrent neural network trained to reconstruct enhanced speech.

Modern speech recognition systems make use of linguistic information in multiple levels. Language models find the probability of word sequences. Words are mapped to phoneme sequences using hand-crafted or learned lexicon lookup tables. Phonemes are modeled as three state left-to-right hidden Markov models (HMMs) where each state distribution usually depends on the context, basically on what phonemes exist within the left and right context window of the phoneme.

The HMM states can be tied across different phonemes and contexts. This can be achieved using a context-dependency tree. Incorporation of the recognition output information at the frame level can be done using various levels of linguistic unit alignment to the frame of interest.

Therefore, we integrate speech recognition and enhancement problems. One architecture uses frame-level aligned state sequences or frame-level aligned phoneme sequences information received from a speech recognizer for each frame of input to be enhanced. The alignment information can also be word level alignments.

The alignment information is provided as an extra feature added to the input of the LSTM network. We can use different types of features of the alignment information. For example, we can use a 1-hot representation to indicate the frame-level state or phoneme. When done for the context-dependent states, this yields a large vector, which could pose difficulties for learning We can also use continuous features derived by averaging spectral features, calculated from the training data, for each state or phoneme. This yields a shorter input representation and provides some a kind of similarity-preserving coding of each state. If the information is in the same domain as the noisy spectral input, then it can be easier for the network to use when finding the speech enhancing mask.

Another aspect of the invention is to have feedback from two systems as an input at the next stage. This feedback can be performed in an "iterative fashion" to further improve the performances.

In multi-task learning, the goal is to build structures that concurrently learn "good" features for different objectives at the same time. The goal is to improve performance on separate tasks by learning the objectives.

Phase-Sensitive Objective Function for Magnitude Prediction

We describe improvements to an objective function used by the BLSTM-DRNN 450. Generally, in the the prior art, the network estimates a filter or frequency-domain mask that is applied to the noisy audio spectrum to produce an estimate of the clean speech spectrum. The objective function determines an error in the amplitude spectrum domain between the audio estimate and the clean audio target. The reconstructed audio estimate retains the phase of the noisy audio signal.

However, when a noisy phase is used, the phase error interacts with the amplitude, and the best reconstruction in terms of the SNR is obtained with amplitudes that differ from the clean audio amplitudes. Here we consider directly using a phase-sensitive objective function based on the error in the complex spectrum, which includes both amplitude and phase error. This allows the estimated amplitudes to compensate for the use of the noisy phases.

Separation with Time-Frequency Masks

Time-frequency filtering methods estimate a filter or masking function to multiply by the frequency-domain feature representation of the noisy audio to form an estimate of the clean audio signal. We define complex short-time spectrum of the noisy audio $y_{f,t}$, the noise $n_{f,t}$ and the audio $s_{f,t}$ obtained via discrete Fourier transform of windowed frames of the time-domain signal. Hereafter, we omit the indexing by f,t and consider a single time frequency bin.

Assuming an estimated masking function $\hat{a}$, the clean audio is estimated as $\hat{s}=\hat{a}y$. During training, the clean and noisy audio signals are provided, and an estimator $\hat{a}=g(y|\theta)$ for the masking function is trained by means of a distortion measure, $\hat{\theta}=\mathrm{argmin}_{\theta}D(\hat{a})$, where $\theta$ represents the phase.

Various objective functions can be used, e.g., mask approximation (MA), and signal approximation (SA). The MA objective functions compute a target mask using y and s, and then measure the error between the estimated mask and the target mask as $$D_{ma}(\hat{a})=D_{ma}(a^*\|\hat{a}).$$

The SA objectives measure the error between the filtered signal and the target clean audio is $$D_{sa}(\hat{a})=D_{ma}(s\|\hat{a}y).$$

Various "ideal" masks have been used for a* in MA approaches. The most common are the so-called "ideal binary mask" (IBM), and the "ideal ratio mask" (IRM).

Various masking functions a for computing a audio estimate $\hat{s}=ay$, their formula in terms of a, and conditions for optimality. In the IBM, $\delta(x)$ is 1 if the expression x is true and 0 otherwise.

TABLE 2

| target mask/filter | formula | optimality principle |
|---|---|---|
| IBM: | $a^{ibm} = \delta(\lvert s\rvert > \lvert n\rvert)$, | max SNR $a \in \{0,1\}$ |
| IRM: | $a^{irm} = \frac{\lvert s\rvert}{\lvert s\rvert + \lvert n\rvert}$, | max SNR $\theta_s = \theta_n$, |
| "Wiener like": | $a^{wf} = \frac{\lvert s\rvert^2}{\lvert s\rvert^2 + \lvert n\rvert^2}$, | max SNR, expected power |
| ideal amplitude: | $a^{iaf} = \lvert s\rvert/\lvert y\rvert$, | exact $\lvert\hat{s}\rvert$, max SNR $\theta_s = \theta_y$ |
| phase-sensitive filter: | $a^{psf} = \lvert s\rvert/\lvert y\rvert \cos(\theta)$, | max SNR given $a \in \mathbb{R}$ |
| ideal complex filter: | $a^{icf} = s/y$, | max SNR given $a \in \mathbb{C}$ |

Phase Prediction for Source Separation and Enhancement

Here, we describe methods for predicting the phase along with the magnitude in audio source separation and audio source enhancement applications. The setup involves using a neural network W for performing the prediction of magnitude and phase of the target signal. We assume a (set of) mixed (or noisy) signal $y(\tau)$, which is a sum of the target signal (or source) $s^*(\tau)$ and other background signals from different sources. We recover $s^*(\tau)$ from $y(\tau)$. Let $y_{t,f}$ and $s^*_{t,f}$ denote the short-time Fourier transforms of $y(\tau)$ and $s^*(\tau)$ respectively.

Naive Approach

In a naive approach, $|\hat{s}_{t,f}-s^*_{t,f}|^2$, where $s^*_{t,f}$ is the clean audio signal, which is known during training, and $\hat{s}_{t,f}$ is the prediction of the network from the noisy signal's magnitude and phase $y=[y_{t,f}]_{t,f\in B}$, that is $$[\hat{s}_{t,f}]_{t,f\in B}=f_W(y),$$

where W are the weights of the network, and B is the set of all time-frequency indices. The network can represent $\hat{s}_{t,f}$ in polar notation as $|\hat{s}_{t,f}|e^{j\theta_{t,f}}=r_{t,f}e^{j\theta_{t,f}}$, or in complex notation as $$Re(\hat{s}_{t,f})+jIm(\hat{s}_{t,f})=u_{t,f}+jv_{t,f},$$

where Re and Im are the real and imaginary parts.

Complex Filter Approach

Often, it can be better to estimate a filter to apply to the noisy audio signal, because when the signal is clean, the filter can become unity, so that the input signal is the estimate of the output signal $$|a_{t,f}e^{j\varphi_{t,f}}y_{t,f}-s^*_{t,f}|^2,$$

where $a_{t,f}$ is a real number estimated by the network that represents the ratio between the amplitudes of the clean and noisy signal. We include $e^{j\varphi_{t,f}}$, where $\varphi_{t,f}$ is an estimate of a difference between phases of the clean and noisy signal. We can also write this as a complex filter $h_{t,f}=a_{t,f}e^{j\varphi_{t,f}}$. When the input is approximately clean, then $a_{t,f}$ is close to unity, and $\varphi_{t,f}$ is close to zero, so that the complex filter $h_{t,f}$ is close to unity.

Combining Approach

The complex filter approach works best when the signal is close to clean, but when the signal is very noisy, the system has to estimate the difference between the noisy and the clean signals. In this case, it may be better to directly estimate the clean signal. Motivated by this, we can have the network decide which method to use, by means of a soft gate, $\alpha_{t,f}$ which is another output of the network and takes values between zero and one and is used to choose a linear combination of the naïve and complex filter approaches for each time frequency output $$|(\alpha_{t,f}a_{t,f}e^{j\varphi_{t,f}}y_{t,f}+(1-\alpha_{t,f})r_{t,f}e^{j\varphi_{t,f}})-s^*_{t,f}|^2,$$

where $\alpha_{t,f}$ is generally set to unity when the noisy signal is approximately equal to the clean signal, and $r_{t,f}$, $\theta_{t,f}$ represent the network's best estimate of the amplitude and phase of the clean signal. In this case the network's output is $$[\alpha_{t,f},a_{t,f},\varphi_{t,f},r_{t,f},\theta_{t,f}]_{t,f\in B}=f_W(y),$$

where W are the weights in the network.

Simplified Combining Approach

The combining approach can have too many parameters, which may be undesirable. We can simplify the combining approach as follows. When $\alpha_{t,f}=1$, the network passes the input directly to the output directly, so that we do not need to estimate the mask. So, we set the mask to unity when $\alpha_{t,f}=1$ and omit the mask parameters $$|(\alpha_{t,f}y_{t,f}+(1-\alpha_{t,f})r_{t,f}e^{j\theta_{t,f}})-s^*_{t,f}|^2,$$

where again $\alpha_{t,f}$ is generally set to unity, when the noisy signal is approximately equal to the clean signal, and when it is not unity, we determine $$(1-\alpha_{t,f})r_{t,f}\theta_{t,f},$$

which represent the network's best estimate of the difference between $\alpha_{t,f}y_{t,f}$ and $s^*_{t,f}$. In this case, the network's output is $$[\alpha_{t,f},r_{t,f},\theta_{t,f}]_{t,f\in B}=f_W(y),$$

where W are the weights in the network. Note that both the combining approach and the simplified combining approach are redundant representations and there can be multiple set of parameters that obtain the same estimate.

Although the invention has been described by way of examples of preferred embodiments, it is to be understood that various other adaptations and modifications may be made within the spirit and scope of the invention. Therefore, it is the object of the appended claims to cover all such variations and modifications as come within the true spirit and scope of the invention.

We claim:

1. A method for transforming a noisy audio signal to an enhanced audio signal, comprising steps:

acquiring the noisy audio signal from an environment;

inputting the noisy audio signal to a deep neural network having network parameters to produce a magnitude mask and a phase estimate, wherein the deep neural network is a deep recurrent neural network (DRNN), a bidirectional long short-term memory (BLSTM) deep recurrent neural network (DRNN) or a long short-term memory (LSTM) network, wherein the deep neural network uses a phase-sensitive objective function based on an error in a complex spectrum that includes an error in amplitude and a phase of the noisy audio signal;

using the magnitude mask and the phase estimate to obtain the enhanced audio signal, wherein the steps are performed in a processor.

2. The method of claim 1, wherein the phase estimate is obtained directly through the deep neural network.

3. The method of claim 1, wherein the phase estimate is jointly obtained with an amplitude of the noisy audio signal using a complex valued mask.

4. The method of claim 1, wherein the step of inputting.

5. An audio signal transformation system comprising:

a sound detecting device configured to acquire a noisy audio signal from an environment;

a signal input interface device configured to receive and transmit the noisy audio signal;

an audio signal processing device configured to process the noisy audio signal, wherein the audio signal processing device comprises:

a processor configured to connected to a memory, the memory being configured to input/output data, wherein the processor executes the steps of:

inputting the noisy audio signal to a deep neural network having network parameters to produce a magnitude mask and a phase estimate, wherein the deep neural network is a bidirectional long short-term memory (BLSTM) deep recurrent neural network (DRNN) or a long short-term memory (LSTM) network, wherein the deep neural network uses a phase-sensitive objective function based on an error in a complex spectrum that includes an error in amplitude and a phase of the noisy audio signal;

using the magnitude mask and the phase estimate to obtain an enhanced audio signal, and a signal output device configured to output the enhanced audio signal.

6. The audio signal transformation system of claim 5, wherein the phase estimate is obtained directly through the deep neural network.

7. The audio signal transformation system of claim 5, wherein the phase estimate is jointly obtained with the amplitude of the noisy audio signal using a complex valued mask.

8. The audio signal transformation system of claim 5, wherein the deep neural network is the LSTM network when the system is online applications.

9. The audio signal transformation system of claim 5, wherein the deep neural network is the BLSTM network when the system is non-online applications.

10. The audio signal transformation system of claim 5, wherein the input step jointly produces the magnitude mask and the phase estimate.

11. The method of claim 1, wherein the deep neural network is the LSTM network when a system is online applications.

12. The method of claim 1, wherein the deep neural network is the BLSTM network when the system is non-online applications.

* * * * *